United States Patent [19]

Demulder

[11] 4,255,835

[45] Mar. 17, 1981

[54] DEVICE FOR OPENING SHELL-FISH

[75] Inventor: Andre E. V. Demulder, Herne, Belgium

[73] Assignee: Crombach Investment Company S.A., Luxembourg

[21] Appl. No.: 69,284

[22] Filed: Aug. 24, 1979

[51] Int. Cl.[3] ..... A22C 29/04
[52] U.S. Cl. ..... 17/76
[58] Field of Search ..... 17/74, 75, 76

[56] References Cited

U.S. PATENT DOCUMENTS

| | | | |
|---|---|---|---|
| 2,520,790 | 8/1950 | Wesik | 17/76 |
| 3,886,628 | 6/1975 | Berry | 17/76 |

*Primary Examiner*—Willie G. Abercrombie
*Attorney, Agent, or Firm*—Bacon & Thomas

[57] ABSTRACT

The present invention pertains to a shell opening device of the type comprising a base carrying an abutment and an opening blade displaceable in a plane perpendicular to the active face of said abutment, characterized in that it comprises means allowing said blade to freely pivot around at least one axis perpendicular to its longitudinal axis.

3 Claims, 2 Drawing Figures

DEVICE FOR OPENING SHELL-FISH

The present invention relates to a device for easily opening bivalvular shell-fish such as oysters, clams and the like. This device is of the type comprising a base provided with an abutment and with an opening blade movable in a plane perpendicular to the active face of said abutment. It is characterized in that it incorporates means to allow free pivotal movement of said blade around an axis perpendicualar to its longitudinal axis.

Devices for opening bivalvular shell-fish are already known. Such devices however all present the disadvantage of frequently shattering peripheral parts of the valves of the shell-fish, with the result that calcareous debris falls upon the eatable part of the shell-fish, considerably lessening the attractiveness thereof.

The object of the present invention is to provide a novel device obviating the disadvantages of the known devices referred to above. This novel device is of the type comprising in combination a base, an abutment and an opening blade displaceable in a plane perpendicular to the active face of said abutment. According to one dominant characteristic of the invention, said blade is mounted so as to be freely slidable round an axis perpendicular to the longitudinal axis of said blade, the latter thus being pivotable and orientable around said axis.

According to another characteristic of the invention, said axis is part of a movable carrier making it easy to modify the distance between the blade and the body, respectively the abutment, according to the dimensions of the shell-fish to be opened.

The problems encountered when opening irregular shell-fish with known devices are eliminated with the device according to the invention, considering that with the latter it is possible to direct or orient at any time the opening blade in the optimal direction between the valves so that breakage of any part of the valves of the considered shell-fish is prevented.

Figure 1:
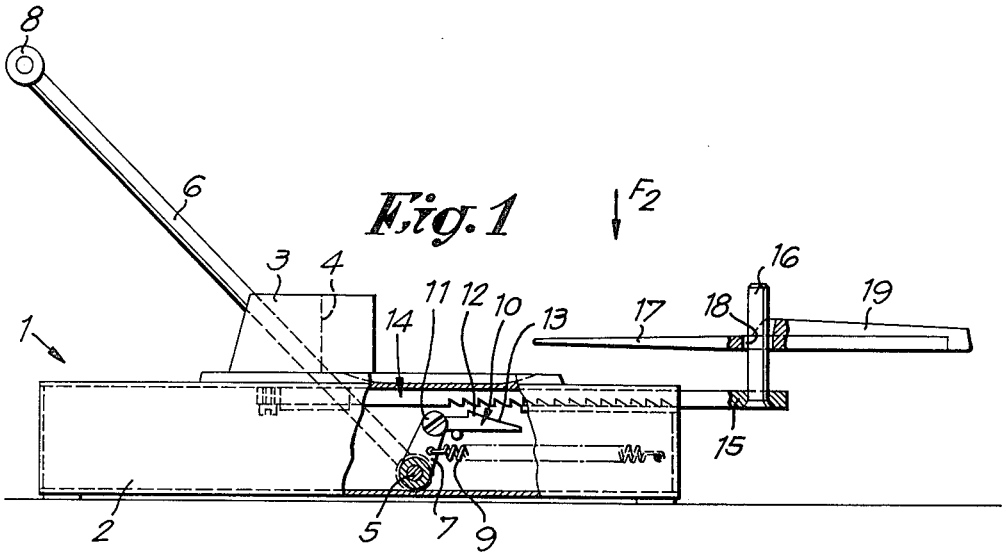
Figure 2:
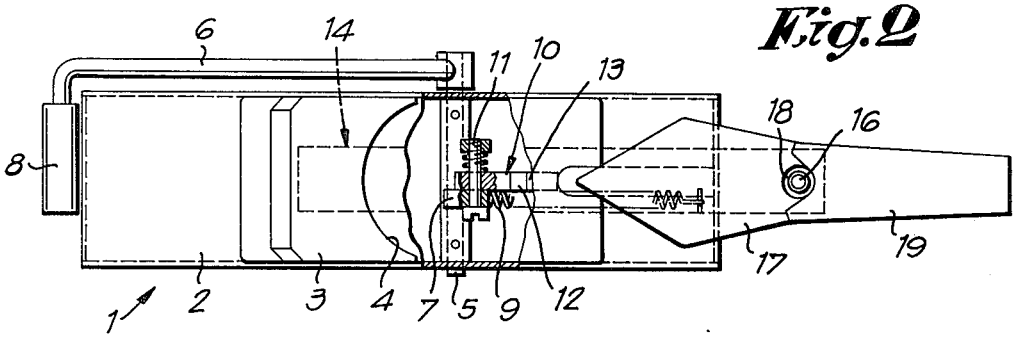

So as to better understand the object of the invention, the latter is described more in detail hereinafter with reference to the appended drawings showing a non-limitative embodiment of the invention. In these drawings:

FIG. 1 shows a side view, partially in section, of the device according to the invention; and FIG. 2 is a view according to arrow F2 of FIG. 1.

The shell opening device 1, as shown in the Figures, comprises a base 2 carrying an abutment 3 with an abutment face 4.

A fixed axle 5 is provided within base 2, a bell-crank lever being pivoted around said axis, said lever having a long arm 6 and a short one 7. At its free extremity, arm 6 is provided with a handle 8. A spring 9 is fixed to arm 7 so as to urge the latter towards its position shown in full lines in the appended drawings.

The free extremity of arm 7 carries a hook 10 pivotely mounted around axis 11. An abutment 12 limits the possible downwards movement of said hook. When said lever is swung conterclockwise, hook 10 meshes with a rackbar 13 slidably mounted in a carrier device 14 fixed to the underside of the upper wall of base 2.

The free extemity 15 of the rackbar 13 carries an axle 16 perpendicular to the plane in which moves said rackbar 13.

A blade 17 is slidably mounted around the axle 16, said blade being substantially diamond-shaped. According to the predominant characteristic of the invention, blade 17 is provided at its posterior extremity with a hole 18, the diameter of which being substantially greater than the outer diameter of axis 16. This allows blade 17 to pivot freely around axle 16, thus permitting suitable positioning of blade 17 against the joint of the valves of the shell-fish before swinging the arm 6 of the lever. Beyond the hole 18, the extremity of blade 17 is provided with a handle 19 facilitating the handling of the blade 17 and its positioning between the valves of a shell-fish.

The functioning of the device according to the invention is quite simple and may be summarized as follows. A shell-fish is placed on the base 2 so that its part opposite to its adducent muscle(s) abuts against the face 4 of abutment 3.

The point of the opening blade 17 is brought, by means of its handle 19, against the joint of the valves of the shell-fish. According to the invention, blade 17 may be oriented as well around its longitudinal axis as round an axis perpendicular to the latter. Furthermore, as said blade is freely mounted around axle 16, the distance between blade 17 and the base 2 can be chosen as a function of the dimensions of the shell-fish.

As soon as blade 17 is correctly positioned against the joint of the valves of the shell-fish, the arm 6 of said lever may be acted upon so as to drive blade 17 to open the shell-fish without any risk of breaking its peripheral parts.

When the first shell-fish has been so opened, it is sufficient to release arm 6 of the lever so that blade 17 returns to its initial position under the influence of spring 9.

It is evident that numerous modifications may be brought to the example hereabove described without departing from the scope of the present invention.

What I claim is :

1. A shell opening device comprising a base having a planar upper face, an abutment projecting upwardly from said face, a shell opening knife having a blade and a handle, said knife having a hole therethrough substantially at the junction of blade and handle, a cylindrical post functionally integral with a supporting means extending through said hole and being slidably mounted in said base, the axis of said post being perpendicular to the plane of said upper face, the diameter of said post being substantially smaller that the diameter of said hole.

2. A shell opening device according to claim 1, wherein a lever operated mechanism is provided to move said supporting means and post towards said abutment.

3. A shell opening device according to claim 2, wherein said mechanism comprises a ratchet pawl engageable with ratchet teeth on said supporting means upon operation of said lever.

* * * * *